US007139506B2

(12) United States Patent
Park et al.

(10) Patent No.: US 7,139,506 B2
(45) Date of Patent: Nov. 21, 2006

(54) MULTI-FUNCTION OFFICE PRODUCT

(75) Inventors: Sang-cheol Park, Suwon-si (KR); Byung-sun Ahn, Suwon-si (KR); Young-min Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/983,636

(22) Filed: Nov. 9, 2004

(65) Prior Publication Data

US 2005/0152715 A1 Jul. 14, 2005

(30) Foreign Application Priority Data

Jan. 12, 2004 (KR) ..... 10-2004-0001952

(51) Int. Cl.
*G03G 15/00* (2006.01)

(52) U.S. Cl. ..... 399/110; 399/118

(58) Field of Classification Search ..... 399/474, 399/110, 1, 107, 118, 47
See application file for complete search history.

(56) References Cited

U.S. PATENT DOCUMENTS

| | | | | |
|---|---|---|---|---|
| 2,035,657 | A * | 3/1936 | Kottemann | 439/135 |
| 4,647,178 | A * | 3/1987 | Sasaki et al. | 399/118 |
| 4,958,188 | A * | 9/1990 | Miyamoto | 399/11 |
| 6,011,940 | A * | 1/2000 | Van Lydegraf | 399/87 |
| 6,466,753 | B1 * | 10/2002 | Kida | 399/107 |
| 6,563,598 | B1 * | 5/2003 | Johnson et al. | 358/1.15 |
| 6,898,395 | B1 * | 5/2005 | Mui et al. | 399/107 |
| 2001/0051051 | A1 * | 12/2001 | Matsumoto | 399/13 |
| 2002/0172528 | A1 * | 11/2002 | Sekine | 399/109 |
| 2004/0062579 | A1 * | 4/2004 | Iwago et al. | 399/367 |

FOREIGN PATENT DOCUMENTS

| | | | |
|---|---|---|---|
| JP | 04-264539 | | 9/1992 |
| JP | 05-201603 | * | 8/1993 |
| JP | 05-201603 A | * | 8/1993 |
| JP | 06-202391 | | 7/1994 |
| JP | 09-200391 | | 7/1997 |
| JP | 2001-022142 | * | 1/2001 |
| JP | 2001-257822 | | 9/2001 |
| KR | 2001-0003543 | | 1/2001 |

* cited by examiner

*Primary Examiner*—Susan Lee
(74) *Attorney, Agent, or Firm*—Roylance, Abrams, Berdo & Goodman LLP

(57) ABSTRACT

A multi-function office product having a printer unit comprising a printer body, print engine and a first connecting portion, removably coupled with a scanner unit comprising a scanner body, flat bed, image sensor and a second connecting portion. The scanner body can be detachably connected to the upper portion of the printer body, wherein the connection of the first and the second connecting portions provides an electrical connection between each. The printer body and the scanner body comprise fastening holes and fastening protrusions for the mechanical connection thereof, and comprise first and second connecting portions for the electrical connection. As a result, connecting and disconnecting the printer unit and the scanner unit becomes easy, and retrieving printed papers and resolving maintenance tasks, such as paper jam removal and repairs, can be carried out with efficiency and convenience.

16 Claims, 6 Drawing Sheets

MULTI-FUNCTION OFFICE PRODUCT

CROSS-REFERENCE TO RELATED APPLICATIONS

This application claims the benefit under 35 U.S.C. §119 (a) of Korean Patent Application No. 2004-01952 filed in the Korean Intellectual Property Office on Jan. 12, 2004, the entire contents of which are incorporated herein by reference.

BACKGROUND OF THE INVENTION

1. Field of the Invention

The present invention relates to a multi-function office product. More particularly, the present invention relates to a multi-function office product having a printer function and a scanner function therein, each being removable from the other.

2. Description of the Related Art

With advancements in the office appliance field, many functions of office appliances are now available in the integrated form of a multi-function product. Such multi-function products usually comprise a scanner function to scan original documents and output image data, a facsimile function to transmit the image data through a communication line, and a printer function to print out the transmitted image data on a suitable recording medium. Therefore, the multi-function product, having various functions such as printing and scanning, is available for performing printer, scanner, facsimile and copier functions according to the selection by the user.

FIG. 1 schematically shows such a conventional multi-function product.

Referring to FIG. 1, the conventional multi-function product 10 comprises a printer unit 20 and a scanner unit 30, each being integrated in the upper portion of the product 10.

The printer unit 20 comprises a printer body 21, a light exposure device 22, a photosensitive drum 23, a developing device 24, a transfer roller 25, a fuser device 26 and a paper feed cassette 27. The paper feed cassette 27 receives a plurality of printing paper sheets therein, and the paper sheets are picked up and conveyed to the photosensitive drum 23 one by one by a pick-up roller 28. A toner image is formed on the surface of the photosensitive drum 23, and is transported to the surface of the printing paper by the transfer roller 25. The printing paper bearing the toner image thereon passes through the fuser device 26, and is discharged to a paper tray 29 mounted at the upper portion of the printer body 21.

The scanner unit 30 comprises a scanner body 31, a flat bed 32, an image sensor 33 and a cover 34. The scanner body 31 is secured to the upper portion of the printer body 21 to cover the paper tray 29, and the cover 34 is openably mounted to the upper portion of the flat bed 32 on which an original document can be placed. The image sensor 33 reads data of the original document while moving along the original document.

As described above, the conventional multi-function product 10 is constructed such that the paper tray 29, where the print-completed paper sheets are fed from the printer unit 20 and stacked, is covered by the scanner body 31. Accordingly, upon completion of the printing, the user has to put his/her hand between the scanner body 31 and the printer body 21 to get the printed paper.

An additional problem encountered is that it is hard to remove a paper sheet if paper jamming occurs in the paper discharging portion. Furthermore, due to the structural characteristic wherein the scanner unit 30 and the printer unit 20 are integrally connected with each other, repair of the device is inconvenient.

Accordingly, a need exists for a multi-function office product providing printing, scanning and other features, and having improved convenience in use and maintenance.

SUMMARY OF THE INVENTION

Accordingly, the present invention has been made to solve the above-mentioned and other problems occurring in the related art. An object of the present invention is to provide a multi-function product providing improved convenience in use and maintenance.

The above objects and/or other features of the present invention can be achieved by providing a multi-function product which comprises a printer unit removably coupled with a scanner unit. The printer unit comprises a printer body, a print engine and a first connecting portion. The scanner unit comprises a scanner body, a flat bed, an image sensor and a second connecting portion. The scanner body is detachably connected to the printer body, and the first and the second connecting portions are electrically connected with each other via the connection of the scanner body and the printer body.

The first connecting portion of the printer unit is provided with the upper portion of the printer body, and the second connecting portion of the scanner unit is provided with the lower portion of the scanner body.

One of the first and second connecting portions comprises a socket connector, while the other one comprises a plug connector.

According to one aspect of the present invention, a protective cap for covering the socket connection may be further provided.

A fastening hole may be formed either in the upper portion of the printer body or in the lower portion of the scanner body, while a fastening protrusion may then be formed on the corresponding location on the other.

An elongated hole may be formed either in the upper portion of the printer body or in the lower portion of the scanner body, while an insertion protrusion may be provided at a corresponding location on the other. The elongated hole is sized to be larger than the fastening hole.

A connection sensor may be provided with either the printer body or the scanner body to detect whether the printer unit and the scanner unit are connected with each other. The connection sensor may be configured as a position sensor installed at a side of the scanner body to detect the location of the image sensor.

A shared manipulation unit, having manipulation buttons for operating the printer unit and the scanner unit, may also be provided at a side of the printer body.

According to another aspect of the present invention, a multi-function product may comprise a printer unit having a printer body, print engine, and first connecting portion, and further include a scanner unit having a scanner body, flat bed, image sensor, sheet feed, and second connecting portion.

BRIEF DESCRIPTION OF THE DRAWINGS

The above objects and features of the present invention will become more apparent by describing certain embodiments of the present invention with reference to the accompanying drawings, in which.

Throughout the drawings, like reference numerals will be understood to refer to like parts, components and structures.

DETAILED DESCRIPTION OF THE EXEMPLARY EMBODIMENTS

Figure 1:
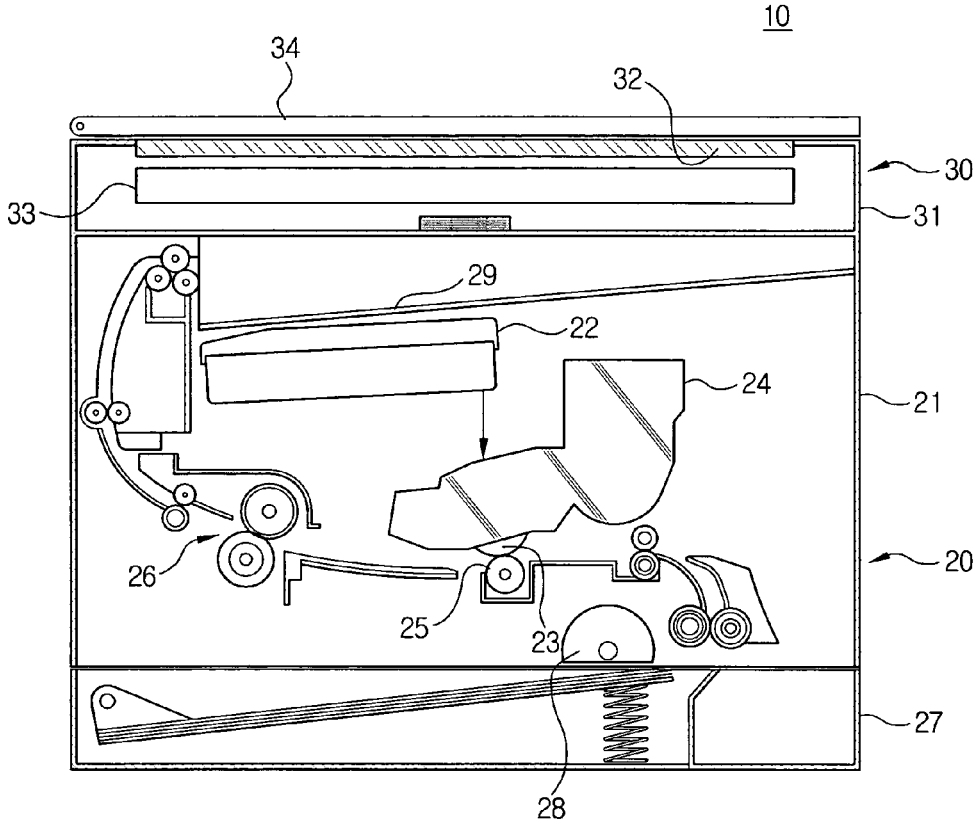
FIG. 1 (PRIOR ART)
FIG. 1 is a schematic view illustrating the structure of a conventional multi-function product.

Certain embodiments of the present invention will be described in greater detail with reference to the accompanying drawings.

In the following description, the same drawing reference numerals are used for the same elements even in different drawings. The matters defined in the description, such as detailed construction and element descriptions, are provided to assist in a comprehensive understanding of the invention. Also, functions or constructions well known to those skilled in the art are not described in detail since they would obscure the invention in unnecessary detail.

Figure 2:
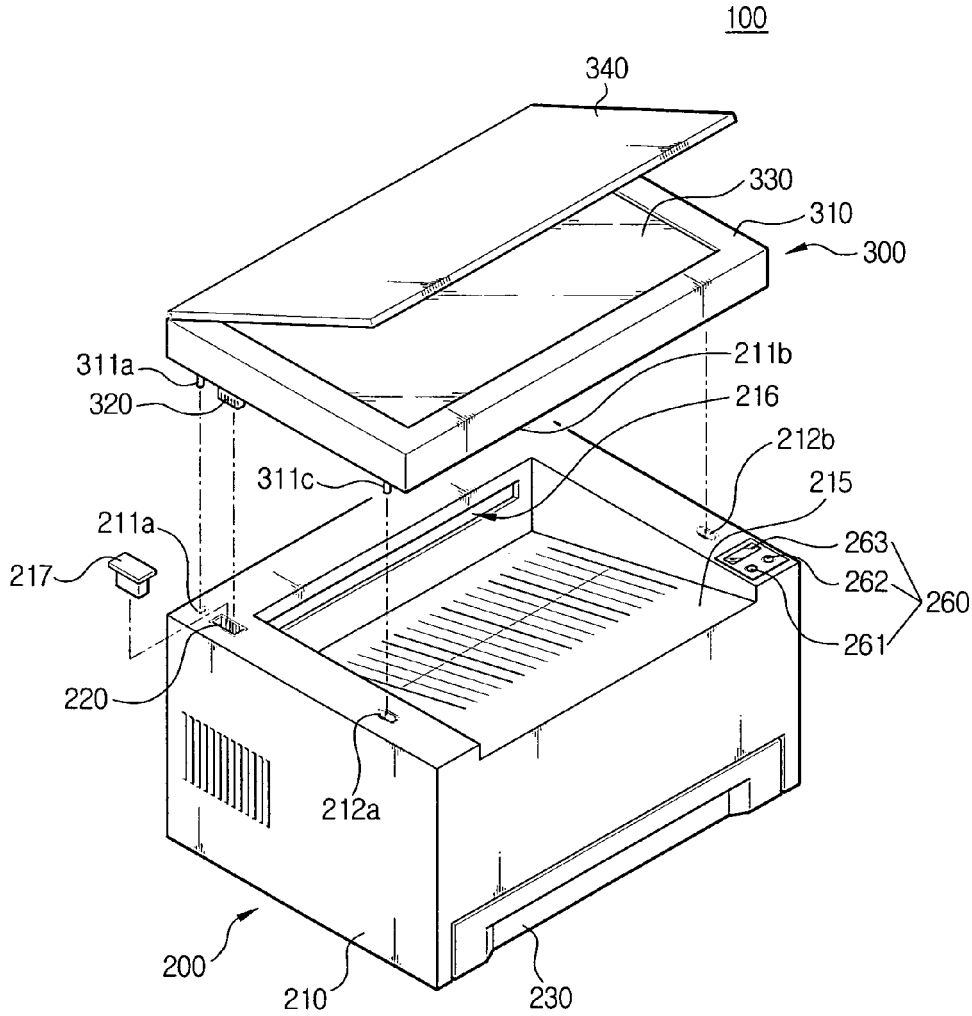
FIG. 2 is a partially exploded, perspective view illustrating the structure of a multi-function product according to an embodiment of the present invention.
Figure 3:
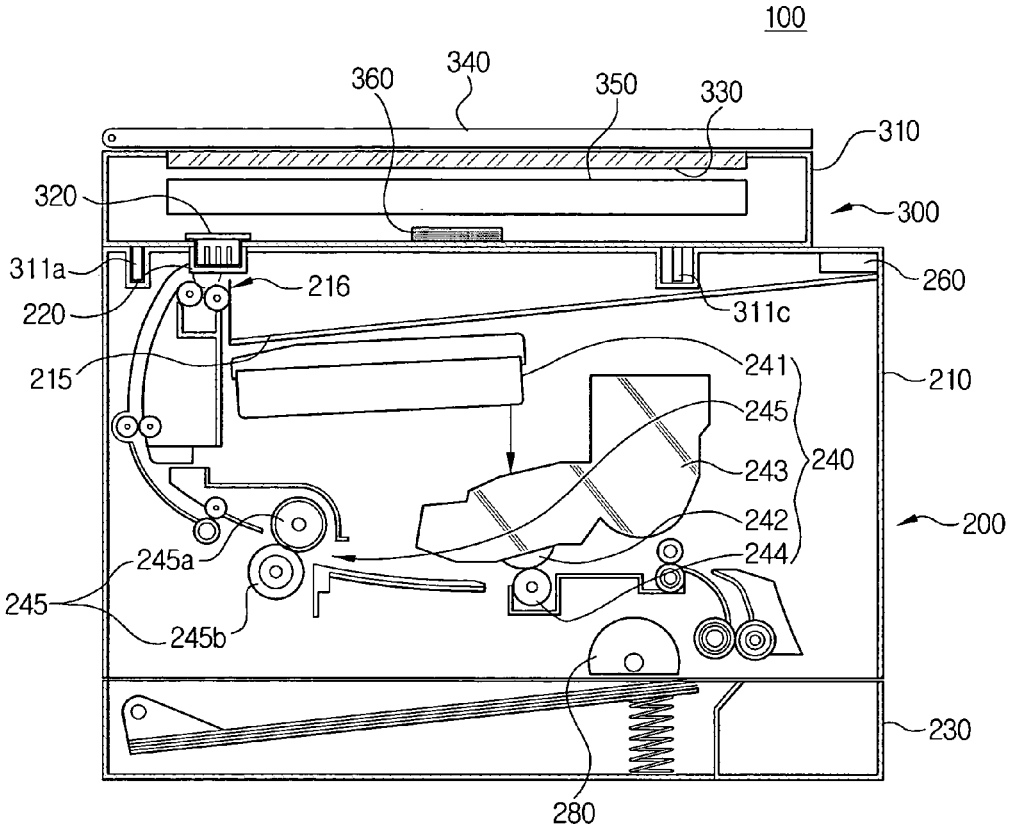
FIG. 3 is a schematic view illustrating the structure of a multi-function product of FIG. 2.

Referring to FIGS. 2 and 3, a multi-function product 100 according to an embodiment of the present invention comprises a scanner unit 300 and a printer unit 200, with the scanner unit 300 being removably connected to the upper portion of the printer unit 200.

Figure 5:
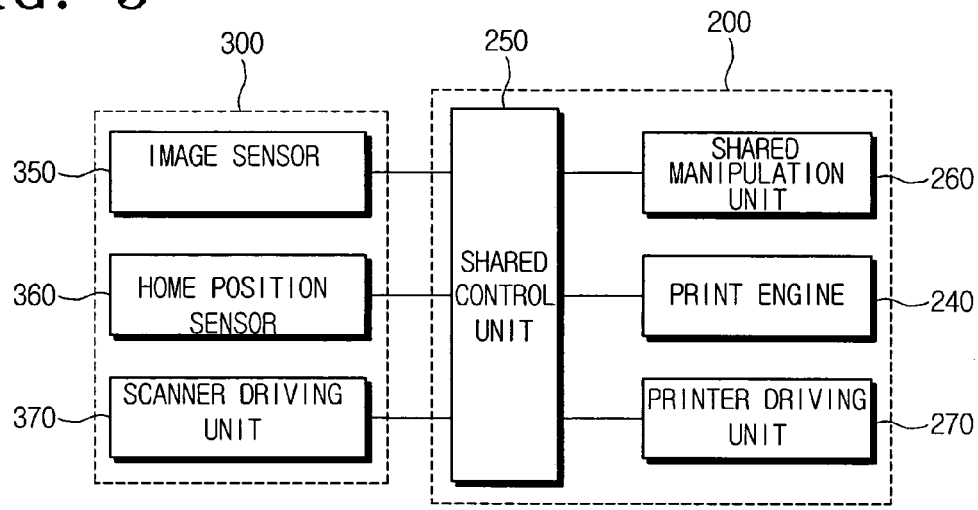
FIG. 5 is a block diagram of the multi-function product of FIG. 3.

The printer unit 200 comprises a printer body 210, a first connecting portion 220, a paper feed cassette 230, a print engine 240 and a shared control unit 250, each coupled as shown in greater detail in FIG. 5.

The printer body 210 defines the appearance of the printer unit 200, and a shared operation unit 260 is formed on the upper portion of the printer body 210. The shared operation unit 260 comprises one or more operation buttons 261 and 262 for operating the printer unit 200 and the scanner unit 300, and a display window 263 for indicating operational status of the printer unit 200 and the scanner unit 300. At least one fastening hole, or pairs of fastening holes 211*a* and 211*b* (fastening hole 211*b* shown in greater detail in FIG. 4) and at least one elongated hole, or pairs of elongated holes 212*a* and 212*b* are formed in appropriate locations of the upper part of the printer body 210 for mechanical connection between the printer unit 200 and the scanner unit 300. A paper tray 215 and a paper discharge portion 216 are formed on one side of the upper part of the printer body 210. The paper tray 215 is formed in the upper side of the printer body 210 at a predetermined slope, and the paper discharge portion 216 is formed facing the paper tray 215. After printing, the printed paper is moved out of the paper discharge portion 216 and stacked on the paper tray 215.

The first connecting portion 220 is provided with the upper portion of the printer body 210 for electrical connection between the printer unit 200 and the scanner unit 300. The first connecting portion 220 is engaged with a second connecting portion 320 of the scanner unit 300 which will be described in greater detail below. As shown in FIG. 2, the first connecting portion 220 can be configured as an inwardly recessed connector, such as a socket-connector.

The paper feed cassette 230 holds a plurality of paper sheets, and is detachably mounted to the lower side of the printer body 210.

The print engine 240 executes printing on the printing paper fed from the paper feed cassette 230 and is shown in greater detail in FIG. 3. The print engine 240 comprises a light exposure device 241, a photosensitive drum 242, a developer device 243, a transfer roller 244 and a fuser device 245. The light exposure device 241 generates a laser beam to emit onto the surface of the photosensitive drum 242. When exposed to the laser beam, the photosensitive drum 242 develops a certain electrostatic latent image thereon. The developer device 243 stores toner therein, and develops the latent image into a visible image by attaching the toner onto the surface of the photosensitive drum 242. To this end, the developer device 243 has a developer roller (not shown) to attach the toner onto the photosensitive drum 242, and a toner feeding roller (not shown) to supply toner to the developer roller. The transfer roller 244 transports the toner image of the photosensitive drum 242 onto the printing paper. The fuser device 245 comprises a heating roller 245*a* and a pressure roller 245*b* to fix the toner image on the printing paper with heat and pressure.

The print engine 240 employed in the present exemplary embodiment is suitable for an electrophotographic printer. However, the present invention may employ a variety of print engines, for example, the present invention may employ a print engine for use in an inkjet type printer which ejects ink droplets onto a paper sheet to print a desired image.

The shared control unit 250 controls the overall operation of the printer unit 200 and the scanner unit 300. The shared control unit 250 may be installed inside the printer body 210. Referring to FIG. 5, the shared control unit 250 is connected with the shared manipulation unit 260, the print engine 240 and a printer driving unit 270. The printer driving unit 270 drives the pickup roller 280, the photosensitive drum 242, the transfer roller 244, the heating roller 245*a*, the pressure roller 245*b* and other rollers disposed in the printer body 210.

The scanner unit 300 comprises a scanner body 310, the second connecting portion 320, a flat bed 330, a cover 340 and an image sensor 350.

The scanner body 310 defines the outer appearance of the scanner unit 300, and is removably mounted to the upper portion of the printer body 210. At least one fastening protrusion, or pairs of fastening protrusions 311*a* and 311*b* (fastening protrusion 311*b* shown in greater detail in FIG. 4), and at least one insertion protrusion, or pairs of insertion protrusions 311*c* and 311*d* (insertion protrusion 311*d* shown in greater detail in FIG. 4) is provided with the lower portion of the scanner body 300 for mechanical connection between the scanner unit 300 and the printer unit 200. The fastening protrusions 311*a* and 311*b*, and the insertion protrusions 311*c* and 311*d* are inserted into the fastening holes 211*a* and 211*b* and the elongated holes 212*a* and 212*b*, respectively, for the connection of the scanner body 310 and the printer body 210.

The second connecting portion 320 is provided with the lower portion of the scanner body 310 for connection with the first connecting portion 220 of the printer unit 200. The second connecting portion 320 can be configured as an outwardly protruding connector, for example a plug-connector as shown in FIG. 2, on the scanner body 310. When the scanner body 310 is connected with the printer body 210, the second connecting portion 320 is inserted into the first connecting portion 220, and as a result, the scanner unit 300 and the printer body 210 are electrically connected with each other.

The flat bed 330 is disposed on the scanner body 310. The flat bed 330 is made from a transparent glass material, and an original document for reproducing is placed thereon.

The cover 340 is openably mounted on the upper portion of the scanner body 310 in a manner for covering the flat bed 330.

The image sensor 350 reads out data from the original document D (shown in FIG. 4) placed on the flat bed 330, and is movably disposed at the lower portion of the flat bed 330 and inside the scanner body 310. The image sensor 350 moves in a length direction shown by arrow A in FIG. 4 along the original document D, reading the data of the original document D, and then returns to the original position. A home position sensor 360 is installed at an inner side of the scanner body 310 to sense the image sensor 350 returning home position.

The scanner driving unit 370 supplies a driving force for moving the image sensor 350.

The assembly method and operation of the multi-function product 100 according to one exemplary embodiment of the present invention will now be described with reference to FIGS. 2 to 5.

The present embodiment will be described with respect to an exemplary example of the multi-function product 100 as shown in FIG. 2. In order to use the multi-function product 100, the scanner unit 300 is disconnected from the printer unit 200 so that the paper tray 215 can be outwardly exposed. The first connecting portion 220 can be covered by a protective cap 217 to block foreign substances from entering into the first connecting portion 220.

When the printer unit 200 receives a command to print, the pickup roller 280 shown in FIG. 3 picks up the paper from the paper feed cassette 230 one by one and supplies each sheet toward the print engine 240. At the same time, a laser beam is irradiated from the light exposure device 241 onto the photosensitive drum 242 such that an electrostatic latent image is formed on the surface of the photosensitive drum 242. The developer device 243 then attaches toner onto the photosensitive drum 242 to form a toner image thereon, and the toner image is transported to the paper sheet by the transfer roller 244. The paper sheet bearing the toner image, is passed through the fuser device 245 and has the toner image fixed on the paper. The paper is passed through the fuser device 245 and is stacked on the paper tray 215. Because the paper tray 215 is upwardly exposed on the printer body 210, the user can get the printed paper from the paper tray 215 with convenience.

Figure 4:
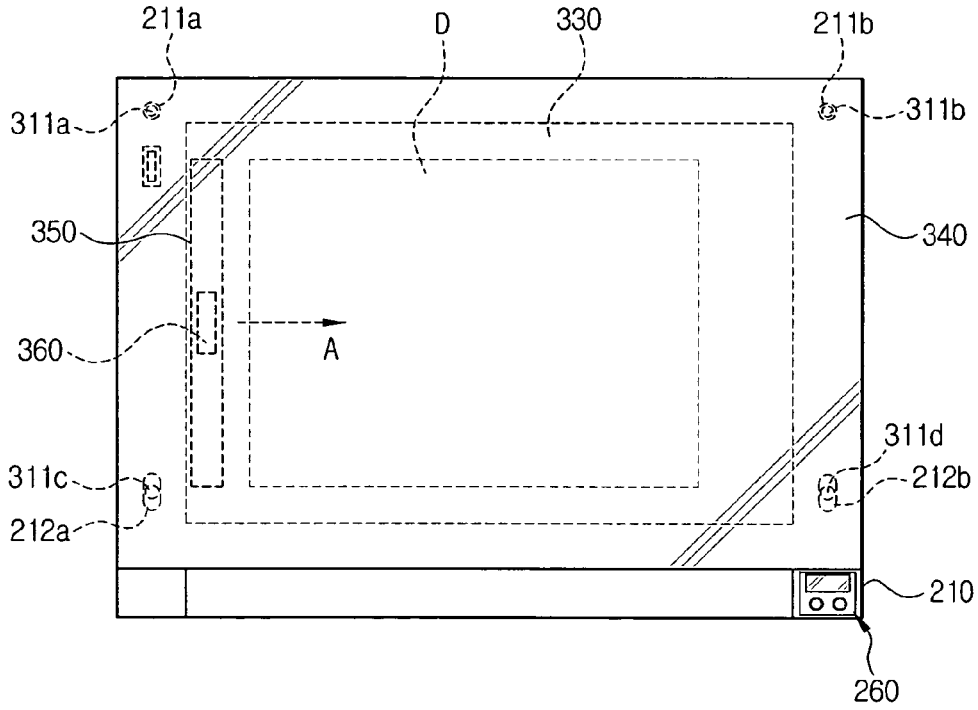
FIG. 4 is an upper plan view illustrating the multi-function product of FIG. 3.

For using the scanner function with the multi-function product 100 according to an exemplary embodiment of the present invention, the scanner body 310 is connected to the printer body 210. In order to connect the scanner body 310 to the printer body 210, first, as shown in FIGS. 3 and 4, the protective cap 217 is removed from the position covering the first connecting portion 220 and the scanner body 310 is connected to the upper portion of the printer body 210. More specifically, the fastening protrusions 311*a* and 311*b* are inserted into the fastening holes 211*a* and 211*b*, and the insertion protrusions 311*c* and 311*d* are inserted into the elongated holes 212*a* and 212*b*. The elongated holes 212*a* and 212*b* have a sufficient size for the insertion protrusions 311*c* and 311*d* to move therein, considering tolerances of the dimensions of each part, so that the insertion protrusions 311*c* and 311*d* can always be inserted in the elongated holes 212*a* and 212*b* smoothly.

When the scanner unit 300 is connected to the printer unit 200, the second connecting portion 320 is inserted into the first connecting portion 220, providing an electrical connection between the printer unit 200 and the scanner unit 300. The home position sensor 360 as shown in FIG. 5, then receives power through the second connecting portion 320, senses the image sensor 350, and sends out the sensed signals to the shared control unit 250 of the printer unit 200. The shared control unit 250 confirms the connection of the scanner unit 300 and the printer unit 200, and may indicate such status through the display window 263.

Referring to FIG. 4, the original document D is placed on the flat bed 330, and a command to scan is applied through the shared manipulation unit 260. The image sensor 350 moves along the length, i.e., along the direction of arrow A, of the original document D reading data.

Figure 6:
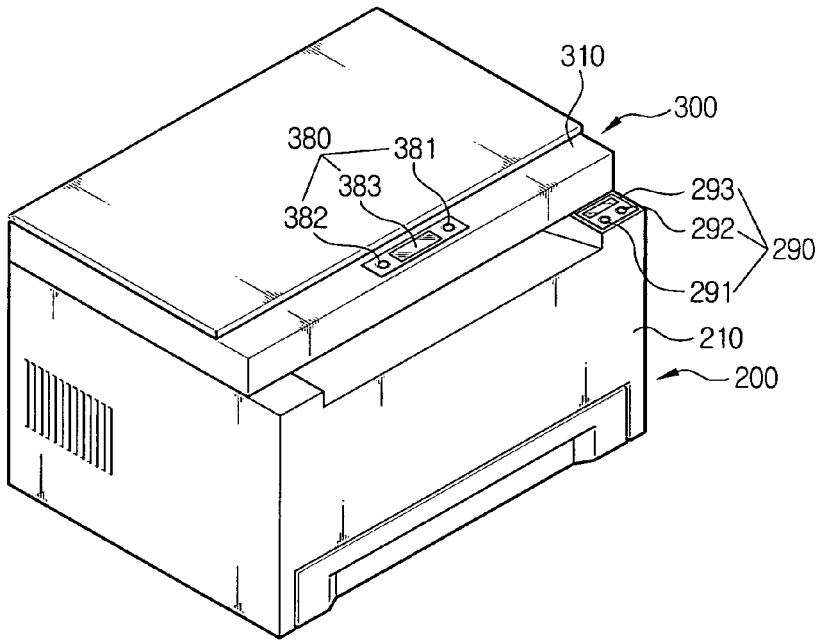
FIG. 6 is a perspective view of a multi-function product according to another embodiment of the present invention.

In the above exemplary embodiment, manipulation of the scanner unit 300 and the printer unit 200 are carried out by the shared manipulation unit 260. However, each unit 300 and 200 may have devoted manipulation units of its own at respectively suitable locations. FIG. 6 shows such an embodiment, wherein the scanner manipulation unit 380 and the printer manipulation unit 290 are provided with each, respectively. In this example, the scanner manipulation unit 380 is provided with scanner manipulation buttons 381 and 382 and a display window 383, and is installed at a side of the scanner body 310. The printer manipulation unit 290 is provided with printer manipulation buttons 291 and 292 and a display window 293, and is installed at a side of the printer body 210. The remaining detailed constructions of the two manipulation units 380 and 290 are generally identical to that of the multi-function product 100 described above.

Figure 7:
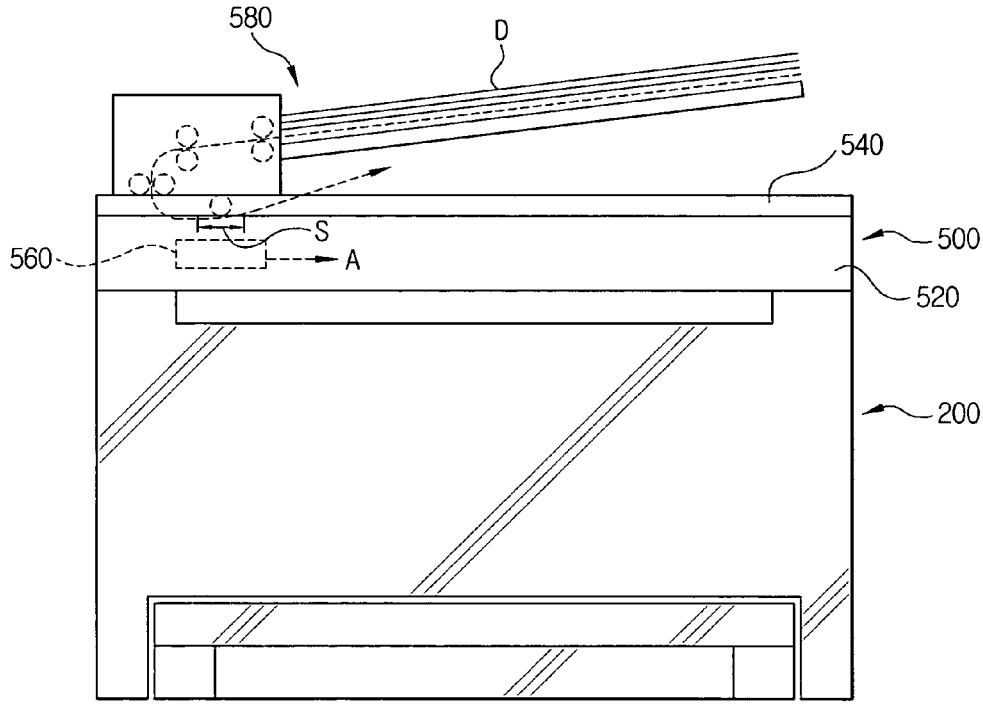
FIG. 7 is an elevational view of a multi-function product according to yet another embodiment of the present invention.

FIG. 7 illustrates another multi-function product constructed in accordance with another embodiment of the present invention. The multi-function product of FIG. 7 comprises first and second connecting portions (not shown) provided at the printer unit 200 and the scanner unit 500, respectively, in a manner such that the printer unit 200 is detachably connected to the scanner unit 500 substantially as the multi-function product described above.

The printer unit 200 according to the embodiment of the present invention shown in FIG. 7 has generally the identical construction as that of the multi-function product described above. The scanner unit 500 according to the embodiment of the present invention shown in FIG. 7 however, comprises a scanner body 520, a cover 540, an image sensor 560 and a sheet feeder 580. A flat bed (not shown) on which an original document for reproducing is placed, and a position sensor (not shown) are respectively provided to the scanner body 520. The sheet feeder 580 may hold a plurality of original documents D thereon, and automatically feeds the original documents D to a sensing position S of the image sensor 560. The image sensor 560 reads the data of the original document D when the original document D is passing through the sensing position S. The sheet feeder 580 may not be used however, each time the device is used. In this case, the cover 540 is opened, and each sheet of the original documents D is set on the flat bed (not shown) disposed at the upper portion of the scanner body 520. The image sensor 560 moves along the length, i.e., along the direction of arrow A, of the original document D placed on the flat bed reading data.

As described above in exemplary embodiments of the present invention, fastening holes and protrusions are provided for mechanical connection, and first and second connecting portions are provided for electrical connection of the printer body and the scanner body. As connecting and disconnecting the printer unit and scanner unit can be carried out easily, getting the printed paper from the product or performing maintenance tasks such as paper jam removal and repair, can be carried out with improved convenience.

Additionally, in the event of abnormality in a certain part of the multi-function product, the damaged part alone can be replaced. Accordingly, the multi-function product requires low maintenance costs.

The foregoing embodiments and advantages are merely exemplary and are not to be construed as limiting the present invention. The present teaching can be readily applied to other types of apparatuses. Also, the description of the embodiments of the present invention is intended to be illustrative and not to limit the scope of the claims, and many alternatives, modifications, and variations will be apparent to those skilled in the art.

What is claimed is:

1. A multi-function office product comprising:

a printer unit comprising a printer body with a paper discharge tray located on an upper surface of the printer body, a print engine disposed inside the printer body for executing printing on a printing paper and a first connecting portion provided with the printer body;

a scanner unit comprising a scanner body, a flat bed provided at a side of the scanner body, an image sensor movably disposed inside the scanner body to read data from a document placed on the flat bed, and a second connecting portion provided with the scanner body; and a position sensor disposed on the scanner body for detecting a position of the image sensor and for detecting whether the printer unit and the scanner unit are connected, wherein, the scanner body is detachably connected to the printer body via the first and second connecting portions, and the scanner body substantially covers the paper discharge tray when the scanner body is detachably connected to the printer body.

2. The multi-function office product of claim 1, wherein the first and second connecting portions are electrically connected with each other when the scanner body is detachably connected to the printer body.

3. The multi-function office product of claim 1, further comprising:

an upper portion of the printer body having the first connecting portion disposed thereon; and a lower portion of the scanner body having the second connecting portion disposed thereon.

4. The multi-function office product of claim 3, wherein:

the upper portion of the printer body further comprises at least one of a fastening hole and a fastening protrusion for insertion into a fastening hole; and the lower portion of the scanner body further comprises at least one of a fastening hole and a fastening protrusion for insertion into a fastening hole.

5. The multi-function office product of claim 4, wherein:

the upper portion of the printer body further comprises at least one of an elongated hole sized larger than the fastening hole and an insertion protrusion for insertion into an elongated hole; and the lower portion of the scanner body further comprises at least one of an elongated hole sized larger than the fastening hole and an insertion protrusion for insertion into an elongated hole.

6. The multi-function office product of claim 1, wherein one of the first and the second connecting portions comprises at least one of a socket connector and a plug connector.

7. The multi-function office product of claim 6, further comprising a protective cap for covering the socket connector.

8. The multi-function office product of claim 1, further comprising:

a shared manipulation unit disposed at a side of the printer body, wherein the shared manipulation unit comprises at least one manipulation button for operating at least one of the printer unit and the scanner unit.

9. The multi-function office product of claim 1, further comprising:

a printer manipulation unit disposed at a side of the printer body; and a scanner manipulation unit disposed at a side of the scanner body, the printer manipulation unit comprising at least one printer manipulation button for operating the printer unit, and the scanner manipulation unit comprising at least one scanner manipulation button for operating the scanner unit.

10. A multi-function office product, comprising:

a printer unit comprising a printer body having a paper discharge tray on an upper surface of the printer body, a print engine disposed inside the printer body for executing printing on a printing paper and a first connecting portion provided with the printer body;

a scanner unit comprising a scanner body, a flat bed provided at a side of the scanner body, an image sensor movably disposed inside the scanner body to read data from a document placed on the flat bed, a sheet feeder provided at a side of the scanner body to feed the document to a data reading position of the image sensor and a second connecting portion provided with the scanner body; and a position sensor disposed on the scanner body for detecting a position of the image sensor and for detecting whether the printer unit and the scanner unit are connected, wherein, the scanner body is detachably connected to the printer body via the first and second connecting portions, and the scanner body substantially covers the paper discharge tray when the scanner body is detachably connected to the printer body.

11. The multi-function office product of claim 10, wherein the first and second connecting portions are electrically connected with each other when the scanner body is detachably connected to the printer body.

12. The multi-function office product of claim 10, further comprising:

an upper portion of the printer body having the first connecting portion disposed thereon; and a lower portion of the scanner body having the second connecting portion disposed thereon.

13. The multi-function office product of claim 10, wherein one of the first and the second connecting portions comprises at least one of a socket connector and a plug connector.

14. A multi-function office product, comprising:

a printer unit including:

a printer body with a paper discharge tray on an upper surface of the printer body, a print engine disposed inside the printer body for printing on a printing paper, a first connecting portion provided on the upper surface of the printer body, at least one fastening hole and at least one elongated hole located on the upper surface of the printer body, the elongated hole being larger than the fastening hole;

a scanner unit detachably connected to the printer unit, the scanner unit including:

a scanner body having an upper surface and lower surface, the scanner body substantially covering the paper discharge tray on the upper surface of the printer body, a flat bed provided on the upper surface of the scanner body to receive documents, an image sensor movably disposed inside the scanner body to read data from documents placed on the flat bed, a second connecting portion provided on the scanner body to mate with the first connecting portion on the printer unit and electrically connect the scanner unit to the printer unit, at least one fastening protrusion located on the lower surface of the scanner body for insertion into the at least one fastening hole in the printer body, and at least one insertion protrusion located on the lower surface of the scanner body for insertion into the at least one elongated hole in the printer body; and a position sensor disposed on the scanner body for detecting a position of the image sensor and for detecting whether the printer unit and the scanner unit are connected.

15. A multi-function office product according to claim 14, further comprising:

a sheet feeder provided on a side of the scanner body to feed documents to the flat bed.

16. The multi-function office product of claim 14, wherein the first connecting portion is a plug connector, and the second connecting portion is a socket connector that mates with the plug connector.

* * * * *